US008122827B2

(12) United States Patent
Conzelmann et al.

(10) Patent No.: US 8,122,827 B2
(45) Date of Patent: Feb. 28, 2012

(54) APPARATUS FOR TURNING A SHEET DURING TRANSPORT THROUGH A PRINTING PRESS

(75) Inventors: Daniel Conzelmann, Dielheim (DE); Peter Hachmann, Dossenheim (DE); Arno Jünger, Nussloch (DE); Markus Kramer, Bammental (DE); Olaf Lorenz, Ludwigshafen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 737 days.

(21) Appl. No.: 11/939,037

(22) Filed: Nov. 13, 2007

(65) Prior Publication Data

US 2008/0289522 A1 Nov. 27, 2008

(30) Foreign Application Priority Data

Nov. 10, 2006 (DE) ..... 10 2006 053 131

(51) Int. Cl.
*B41F 21/00* (2006.01)

(52) U.S. Cl. ..... 101/410; 101/230; 101/246

(58) Field of Classification Search ..... 101/230, 101/232, 246, 408, 409, 410; 271/82, 277, 271/317

See application file for complete search history.

(56) References Cited

U.S. PATENT DOCUMENTS

| | | | | |
|---|---|---|---|---|
| 4,202,268 | A * | 5/1980 | Becker | 101/409 |
| 4,204,471 | A | 5/1980 | Becker | |
| 5,172,634 | A * | 12/1992 | Iwamoto | 101/410 |
| 5,701,819 | A * | 12/1997 | Stephan | 101/409 |
| 6,659,456 | B2 | 12/2003 | Hieb | |
| 6,722,276 | B1 | 4/2004 | Helmstädter | |
| 7,320,281 | B2 * | 1/2008 | Becker et al. | 101/409 |

FOREIGN PATENT DOCUMENTS

| | | | |
|---|---|---|---|
| DE | 2632243 | A1 | 1/1978 |
| DE | 4424968 | A1 | 1/1996 |
| DE | 19949412 | A1 | 4/2001 |
| DE | 10102226 | A1 | 7/2002 |
| EP | 1516728 | A2 | 3/2005 |

* cited by examiner

*Primary Examiner* — Ren Yan

(74) *Attorney, Agent, or Firm* — Laurence A. Greenberg; Werner H. Stemer; Ralph E. Locher

(57) ABSTRACT

An apparatus for turning a sheet during transport through a printing press provides better printed results as a result of improved sheet guidance. A transfer drum has gripper systems disposed in channels for holding the sheet at the leading and trailing sheet edge, and guide elements covering the channels.

6 Claims, 8 Drawing Sheets

APPARATUS FOR TURNING A SHEET DURING TRANSPORT THROUGH A PRINTING PRESS

CROSS-REFERENCE TO RELATED APPLICATION

This application claims the priority, under 35 U.S.C. §119, of German Patent Application DE 10 2006 053 131.0, filed Nov. 10, 2006; the prior application is herewith incorporated by reference in its entirety.

BACKGROUND OF THE INVENTION

Field of the Invention

The invention relates to an apparatus for turning a sheet during transport through a printing press. The apparatus includes a first transfer drum having gripper systems disposed in channels for holding the sheet at the leading and trailing sheet edge, a second transfer drum having a gripper system for accepting the sheet from the first transfer drum at the trailing sheet edge, and at least one drive for synchronous revolution of the transfer drums.

In order to keep down the production costs of a multicolor sheet-fed printing press, printing units are constructed to print on only one side of a sheet and the printing units are fabricated with a high degree of part repetition. If, in the case of a sheet-fed printing press having an inline configuration of the printing units, the intention is to print on both sides of the sheet, a turning apparatus for the sheets is provided between the last printing unit for printing on the front side and a following printing unit for printing on the rear side. Conventional turning apparatuses include a transfer drum, a storage drum and a turning drum between impression cylinders of the printing units. The transfer drum has a gripper system for holding a sheet at the front edge. The storage drum is implemented with a diameter twice as large as the impression cylinders and has two gripper systems for holding the sheet at the front edge and two suction gripper systems for holding the sheet at the rear edge. The turning drum has a tongs-type gripper system for holding the sheet edge trailing on the storage drum. All of the sheet-carrying cylinders are driven so as to revolve synchronously, for example by a gear mechanism.

The gripper systems of the storage drum and of the turning drum each include individual grippers disposed along a straight gripper closing line. The gripper closing lines in each case lie parallel to the axis of rotation of the storage drum and the turning drum. As is seen in the axial direction of the storage drum and of the turning drum, gripper closing lines of the turning drum and of the storage drum during a sheet transfer form a common tangent line which runs through a center line that passes through the axes of rotation.

In order to turn a sheet, it is transferred from the gripper system of the transfer drum to a gripper system for the front sheet edge of the storage drum. During the rotation on the storage drum, the rear sheet edge is held by an associated suction gripper system of the storage drum. The sheet is led past the tangent line by the leading edge gripper system of the storage drum. Once the rear edge of the sheet reaches the tangent line, a transfer is made to the tongs-type grippers of the turning drum. During the further revolution of the drums, the sheet is peeled off the circumferential surface of the storage drum and the suction action of the suction grippers is cancelled. The vacuum of the suction grippers is led to the storage drum through a rotary leadthrough. If the leading-edge gripper system of the storage drum opens at a predefined angle of rotation, a free flight phase of the sheet begins. The sheet is then held only at one sheet edge by the tongs-type grippers of the turning drum until it is transferred to the gripper system of the impression cylinder disposed downstream.

During the detachment from the storage drum, at the edge on which the tongs-type grippers act, the sheet has a different speed from the freely flying new rear edge. Before leaving the storage drum, the future rear edge of the sheet is moved at the orbital velocity of the storage drum. The speed of the future rear edge subsequently decreases to zero. The direction of movement of the rear edge then changes from zero to an orbital velocity which results from the rotation of the tongs-type grippers of the turning drum.

Due to the speed changes, the sheet is moved out of its ideal path as a result of dynamic forces and other external interfering forces. The storage drum does not have an ideal aerodynamic external contour because of channels with the gripper components located therein. The sheet guided forcibly at the front edge by the tongs-type grippers of the turning drum and carried freely at the rear edge tends to form waves and, as a result of flapping effects, to collide with components of the storage drum and guide elements, which leads to undesired printed results.

In order to avoid a collision between a sheet and components of a storage drum, in a turning apparatus according to German Published, Non-Prosecuted Patent Application DE 199 49 412 A1, corresponding to U.S. Pat. Nos. 6,722,276 and 7,207,265, the storage drum is constructed with a recess that is open at the edge. Air is introduced through the recess in a vacuum region, which results in a space between the storage drum, the turning drum and the sheet during the detachment.

A sheet transport drum described in German Published, Non-Prosecuted Patent Application DE 101 02 226 A1, corresponding to U.S. Pat. No. 6,659,456, includes comb segments which can be rotated relative to one another in order to set them to a format length. Interspaces between prongs of the comb segments are provided with a covering for aerodynamic reasons. Channel regions of the drum are kept open for a passage of gripper systems of adjacent drums.

BRIEF SUMMARY OF THE INVENTION

It is accordingly an object of the invention to provide an apparatus for turning a sheet during transport through a printing press, which overcomes the hereinafore-mentioned disadvantages of the heretofore-known apparatuses of this general type and which permits better printing results as a result of improved sheet guidance.

With the foregoing and other objects in view there is provided, in accordance with the invention, an apparatus for turning a sheet during transport through a printing press. The apparatus comprises a first transfer drum having gripper systems disposed in channels for holding the sheet at leading and trailing sheet edges. A second transfer drum has a gripper system for accepting the sheet from the first transfer drum at the trailing sheet edge. At least one drive is provided for the synchronous revolution of the transfer drums. Guide elements cover the channels.

According to the invention, a transfer drum has gripper systems disposed in channels and guide elements thereon partly or completely covering the channels. Therefore, the aerodynamics of the transfer drum are improved in such a way that a sheet accepted from an adjacent drum does not enter into a channel of the transfer drum, so that there is no collision between the sheet and grippers on the transfer drum.

Other features which are considered as characteristic for the invention are set forth in the appended claims.

Although the invention is illustrated and described herein as embodied in an apparatus for turning a sheet during transport through a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
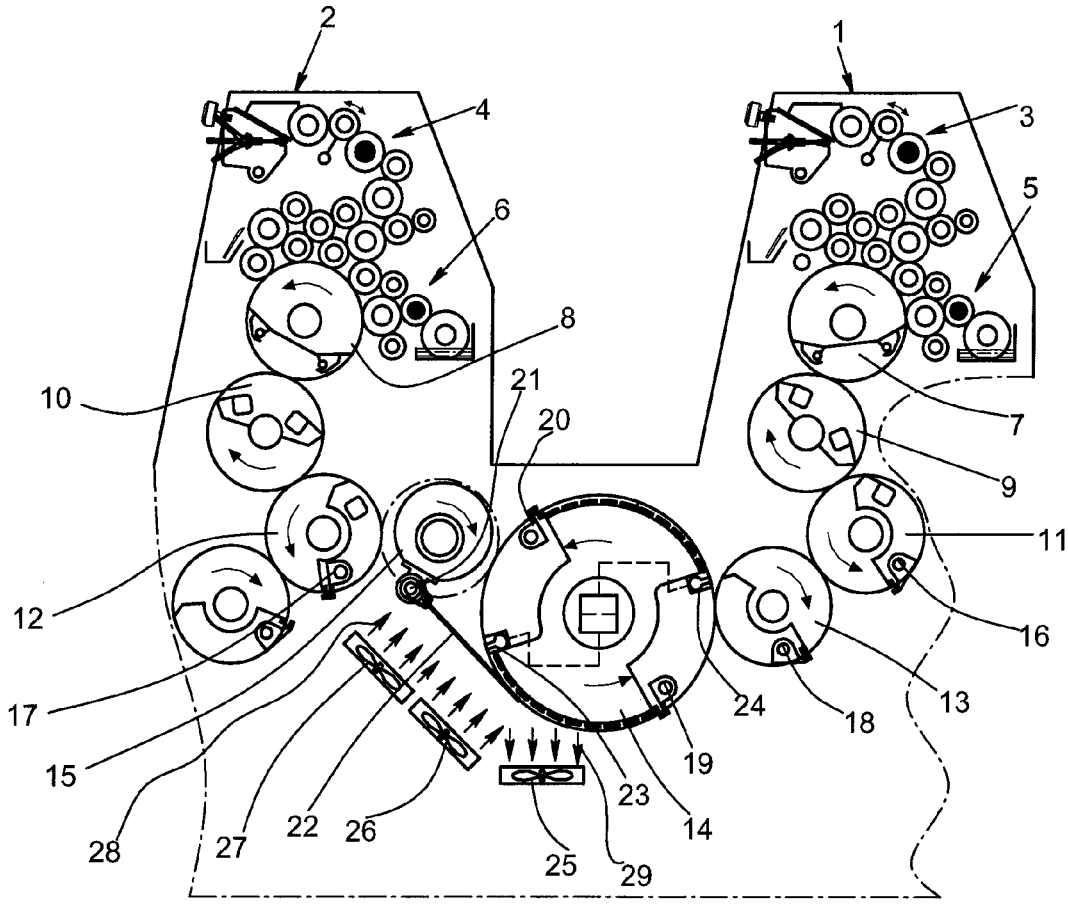
FIG. 1 is a diagrammatic, cross-sectional view of two printing units and a turning apparatus of a sheet-fed press.

Referring now to the figures of the drawings in detail and first, particularly, to FIG. 1 thereof, there are seen two printing units 1, 2 of a sheet-fed press, in each case having an inking unit 3, 4, a damping unit 5, 6, a plate cylinder 7, 8, a transfer cylinder 9, 10 and an impression cylinder 11, 12. A turning apparatus, which is disposed between the printing units 1, 2, has a transfer drum 13, a storage drum 14 and a turning drum 15. All of these cylinders and drums are coupled to a gear train or drive, represented by arrows, for synchronous revolution in the direction of the arrows. The impression cylinders 11, 12, the transfer drum 13, the storage drum 14 and the turning drum 15 have gripper systems 16-21 for holding a sheet 22 at the leading sheet edge. The storage drum 14 additionally has suction gripper systems 23, 24 for holding a sheet 22 at the trailing sheet edge. Pneumatic sheet guides 25-27, from which blown air 28 emerges and vacuum 29 enters, are disposed along the conveying or transport path of the sheet 22 between the storage drum 14 and the turning drum 15. The drums 14 and 15 may be described as first and second transfer drums, with regard to the transfer of the sheets 22.

Figure 2:
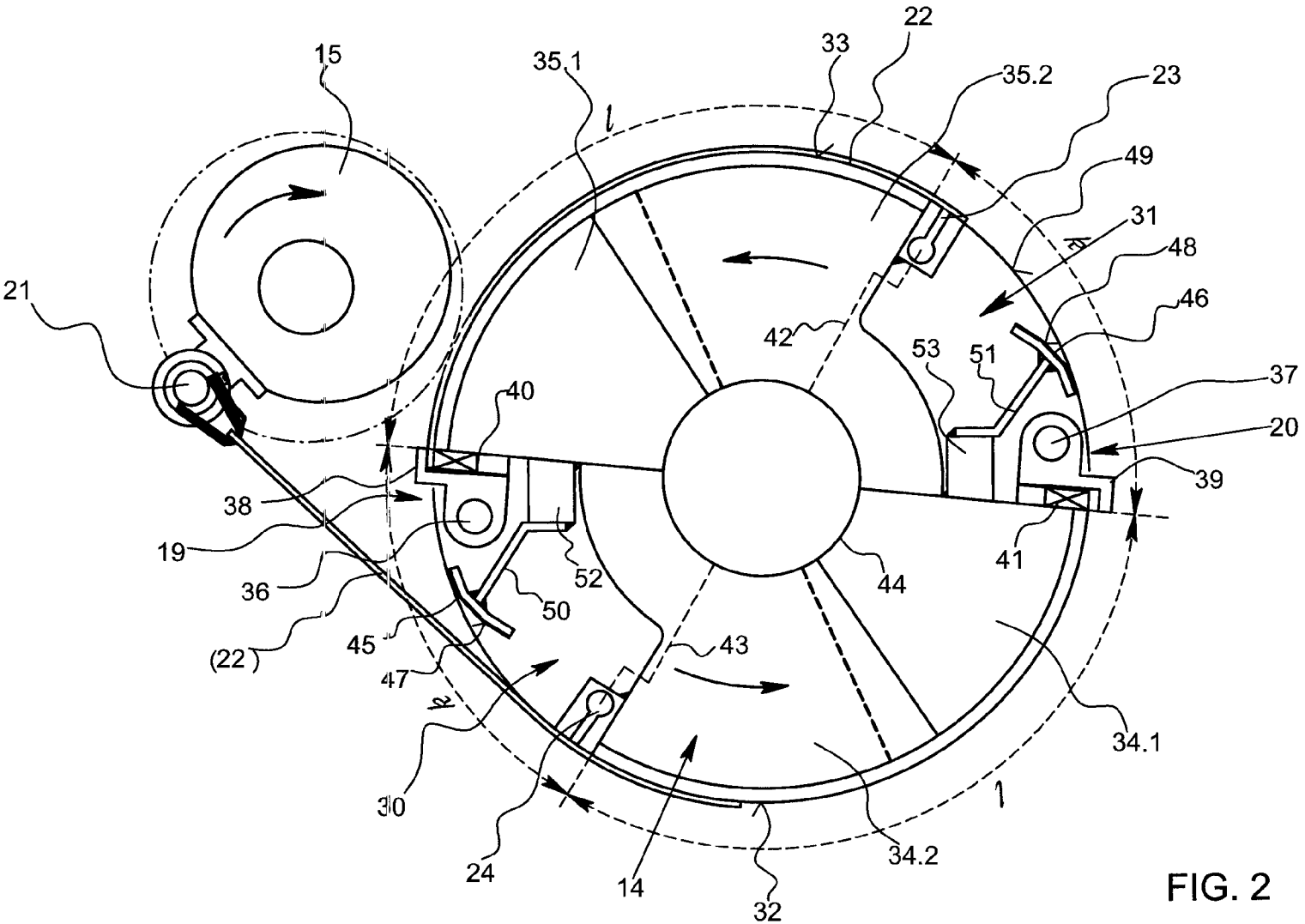
FIG. 2 is an enlarged, cross-sectional view of a storage drum having guide devices fixed on a gripper side.

As is seen in more detail in FIG. 2, the gripper systems 19, 20 and the suction gripper systems 23, 24 are disposed in channels 30, 31 in the storage drum 14. The storage drum 14 is constructed with a diameter twice as large as the impression cylinders 11, 12. The storage drum 14 has two circumferential surface segments 32, 33 with a circumferential length l that can be set to the length of the sheets 22 to be conveyed. During the setting of the circumferential surface segments 32, 33, the gripper systems 19, 23 and 20, 24 are likewise set to the sheet length. Depending on the sheet length, the channels 30, 31 extend over a resultant circumferential length k. The circumferential surface segments 32, 33 each include two groups of curved holders 34.1, 34.2, 35.1, 35.2 which, as seen in axial direction of the storage drum 14, interengage in the manner of combs and have sheet support surfaces with suction grooves. The gripper systems 19, 20 each include a large number of pivotable gripper fingers 38, 39 which are disposed in a row on a gripper shaft 36, 37 and which interact with gripper pads 40, 41. The mountings of the gripper shafts 36, 37 and the gripper pads 40, 41 are in each case structurally connected to the holders 34.1, 35.1. The suction gripper systems 23, 24 each include a large number of suckers disposed in a row. Suction lines 42, 43 lead from the suckers, through a rotary leadthrough on one journal 44 of the storage drum 14, to a stationary vacuum source. The suction gripper systems 23, 24 are structurally connected to the holders 34.2, 35.2.

In addition to the bearings for the gripper shafts 36, 37 and the gripper pads 40, 41, guide plates 45, 46 are fixed to the holders 34.1, 35.1. The guide plates 45, 46 form guide surfaces 47, 48, which are inclined relative to a contour of revolution 49 of the circumferential surface segments 32, 33. The guide surfaces 47, 48 rise gently from the interior of the channels 33, 31, in each case in the direction of the gripper systems 19, 20. The radially outermost ends of the guide surfaces 47, 48 are located at the level of the contour of revolution 49. The guide plates 45, 46 are connected to the holder 34.1, 35.1 through webs 50, 51 and bars 52, 53. As a sheet 22 is pulled off the sheet supporting surfaces of the holders 34 or 35 by the tongs-type gripper system 21 of the turning drum 15, the respective guide surface 47, 48 prevents the end of the sheet from entering into the channel 30 or 31.

Figure 3:
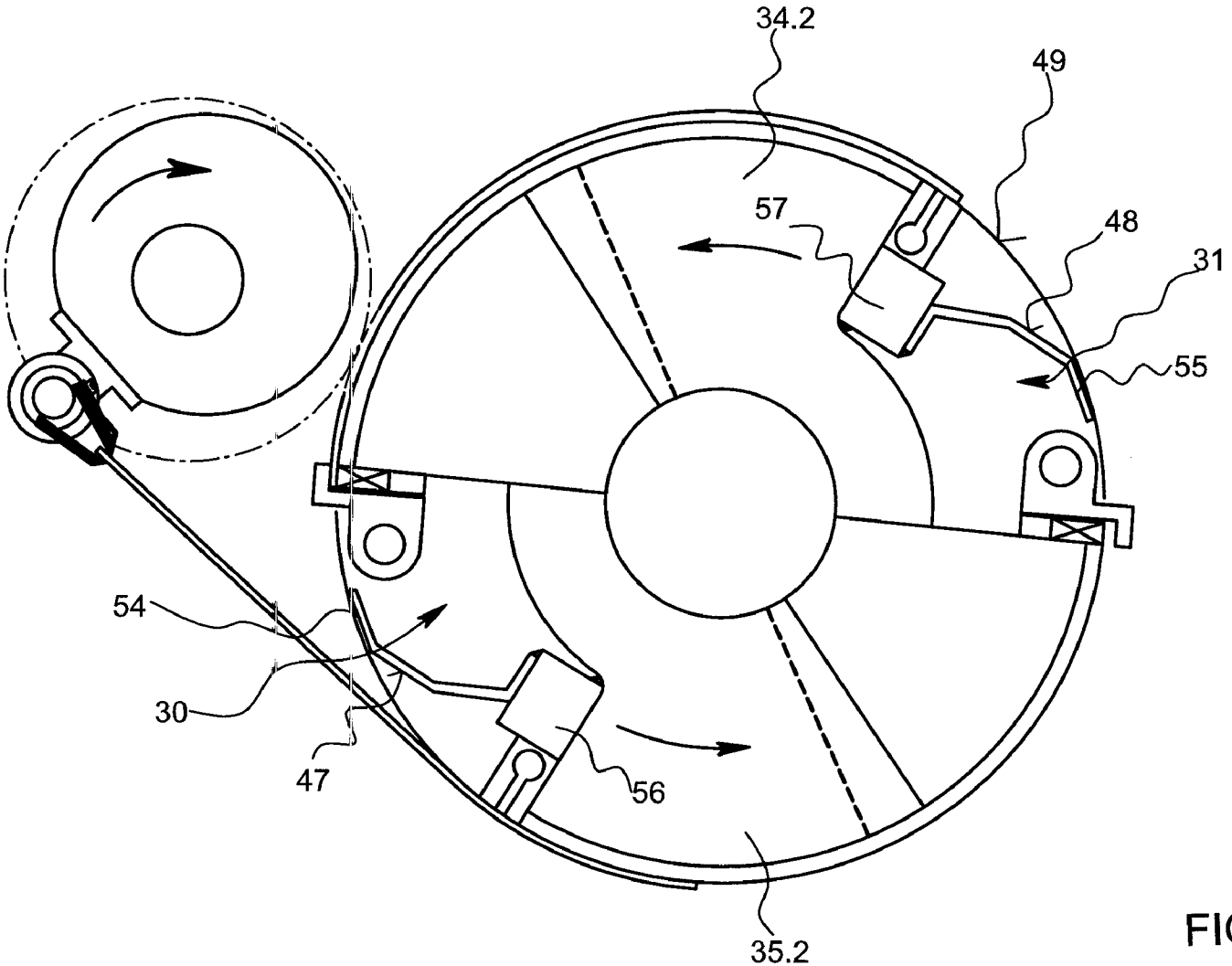
FIG. 3 is a cross-sectional view of a storage drum having guide devices fixed on a sucker side.

FIG. 3 shows guide plates 54, 55 which are each fixed to a bar 56, 57, connected to the holders 34.2, 35.2. The guide surfaces 47, 48 formed with the guide plates 54, 55 likewise rise from the interior of the channels 30, 31 to the level of the contour of revolution 49.

Figure 4:
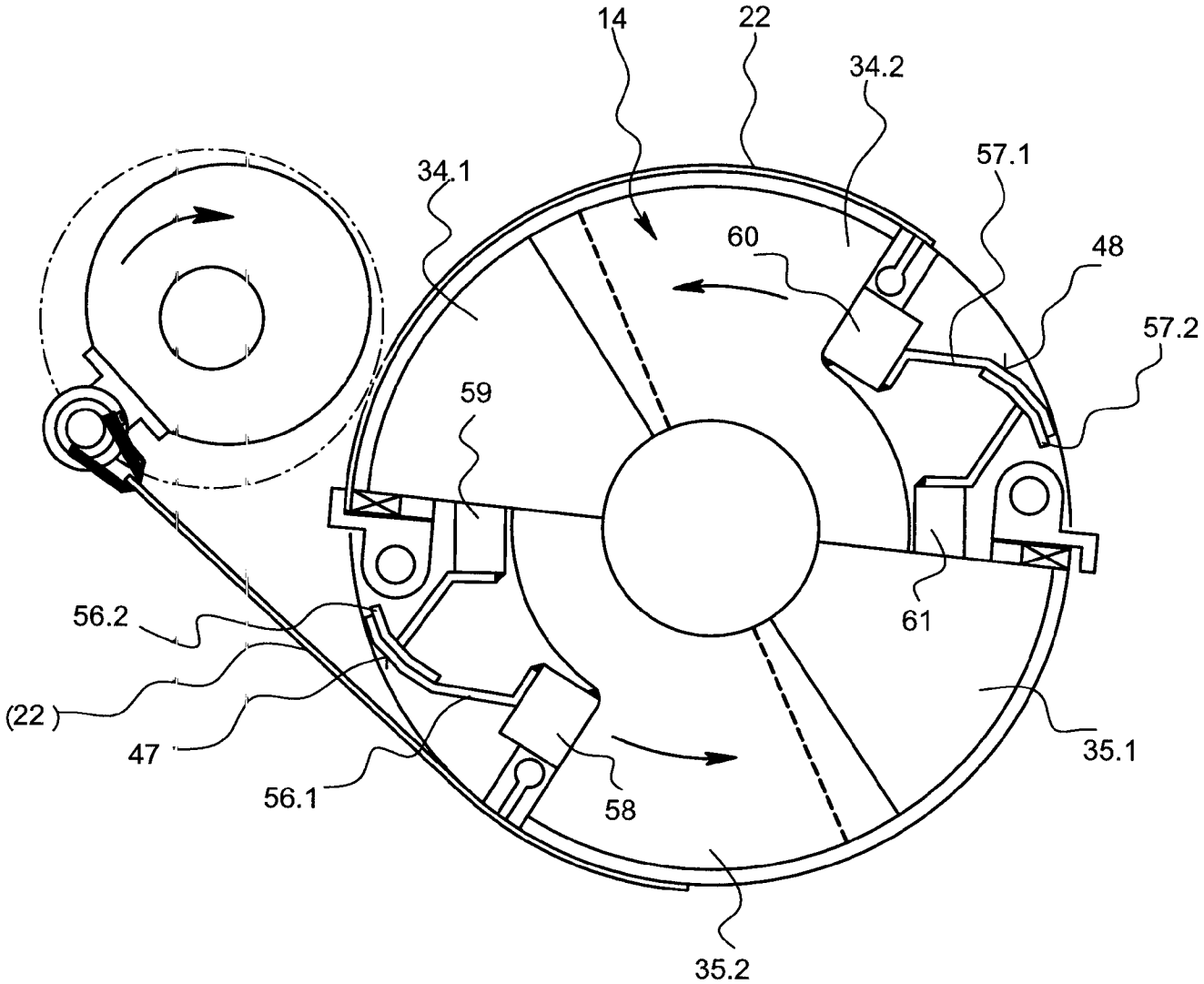
FIG. 4 is a cross-sectional view of a storage drum having guide devices fixed on the gripper and sucker sides.

In a variant according to FIG. 4, guide devices each including a pair of interacting guide plates 56.1, 56.2 and 57.1, 57.2 are provided. The guide plates 56.1, 56.2 and 57.1, 57.2 are fixed to the holders 35.2, 34.1 and 34.2, 35.1 by respective bars 58-61. If, during a format setting, the holders 34.1, 34.2 and 35.1, 35.2 are rotated toward each other in the circumferential direction of the storage drum 14, then the guide plates 56.1, 56.2 and 57.1, 57.2 are pushed toward one another, so that a channel area covered by the guide plates 56.1, 56.2; 57.1, 57.2 is adapted in a manner corresponding to the format of the sheet 22. The surfaces of the guide plates 56.1, 56.2; 57.1, 57.2 form the guide surfaces 47, 48 for a sheet 22 moving away from the storage drum 14.

Figure 5:
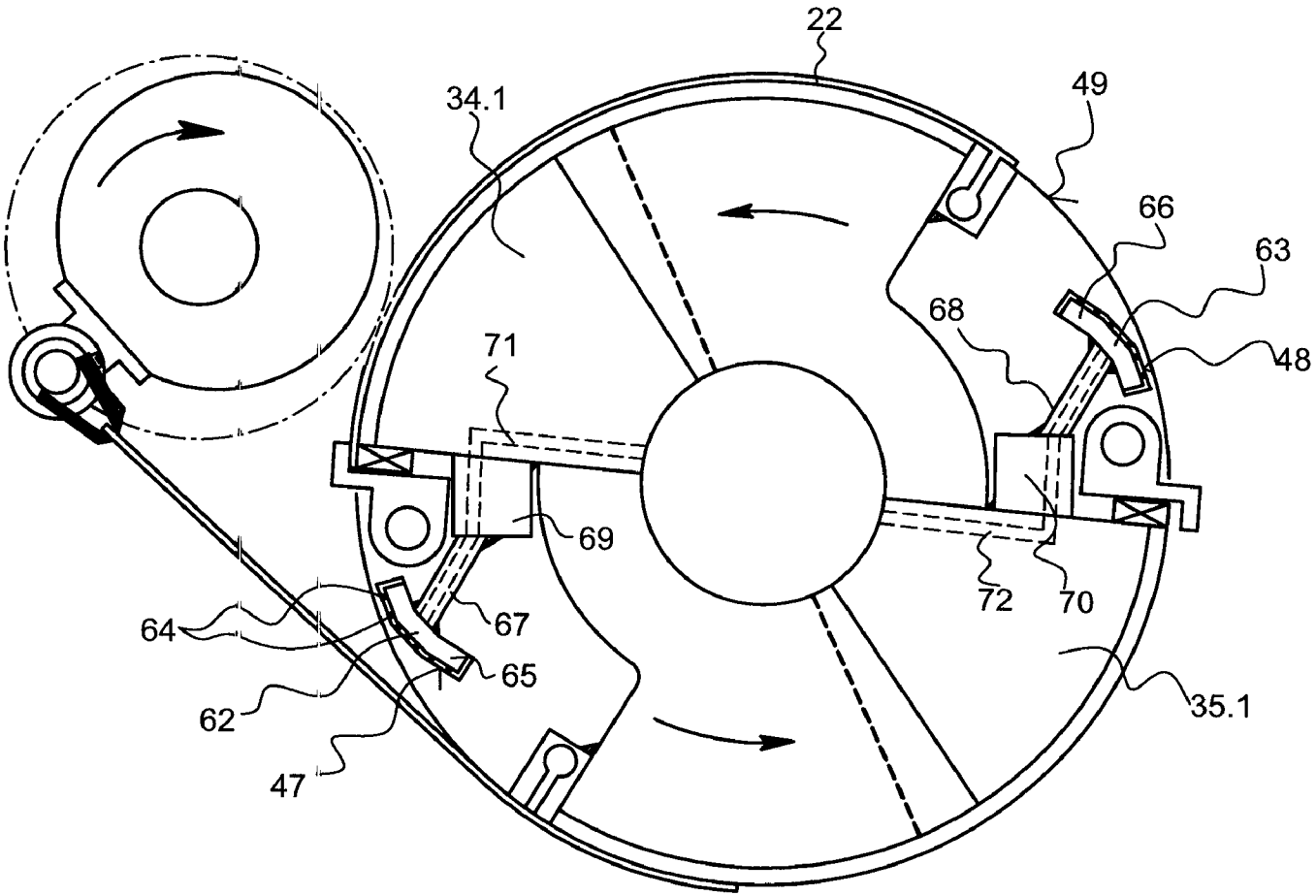
FIG. 5 is a cross-sectional view of a storage drum having pneumatic guide devices.

FIG. 5 shows a variant having guide devices which in each case have a guide plate 62, 63 with air passage openings 64. An air chamber 65, 66 is disposed underneath the guide plates 62, 63 in each case. The guide devices are fixed to the holders 34.1, 35.1 by webs 67, 68 and bars 69, 70. Pneumatic lines 71, 72 lead from the air chambers 65, 66 to a stationary vacuum and/or blown air source. The air passage openings 64 in each case open in a guide surface 47, 48 predefined by the guide plates 62, 63 which, as described in relation to FIGS. 2-4, lies at an angle with respect to the contour of revolution 49.

Figure 6:
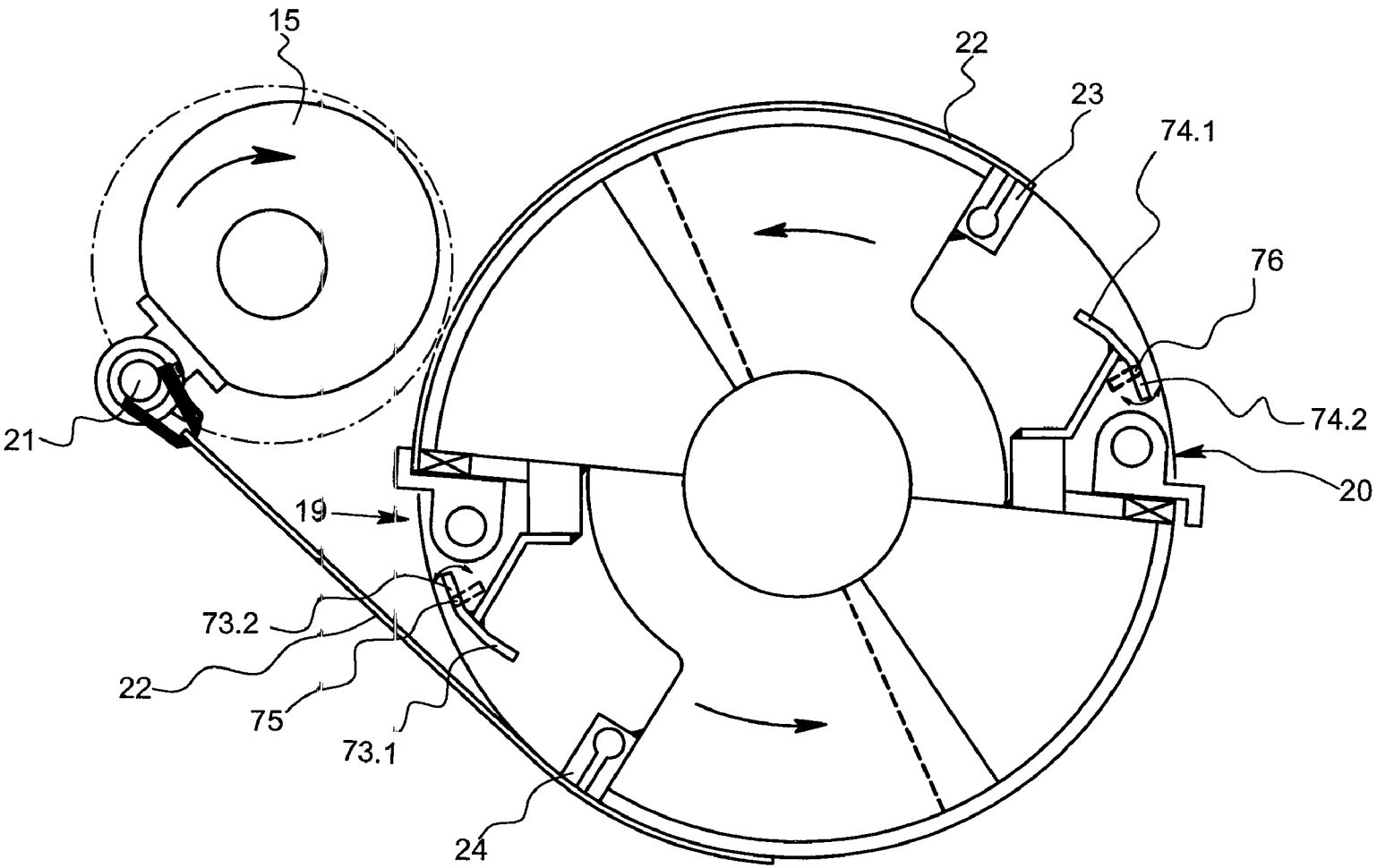
FIG. 6 is a cross-sectional view of a storage drum having folding guide devices.

FIG. 6 shows guide devices which each include two guide plates 73.1, 73.2; 74.1, 74.2 connected to each other in an articulated manner. During the transfer of the sheet 22 to the turning drum 15, the tongs-type grippers of the tongs-type gripper system 21 in each case move into an interspace between the guide plate 73.1, 74.1 and the suction gripper system 24 or 23. If the turning apparatus is to be changed over in order to print on only one side, a clearance between the guide plate 73.1, 74.1 and the gripper system 19 or 20 must be kept free. Therefore, in recto printing operation, the guide plates 73.2 and 74.2 are folded away about joints 75, 76 into the interior of the respective channel 30, 31.

Figure 7:
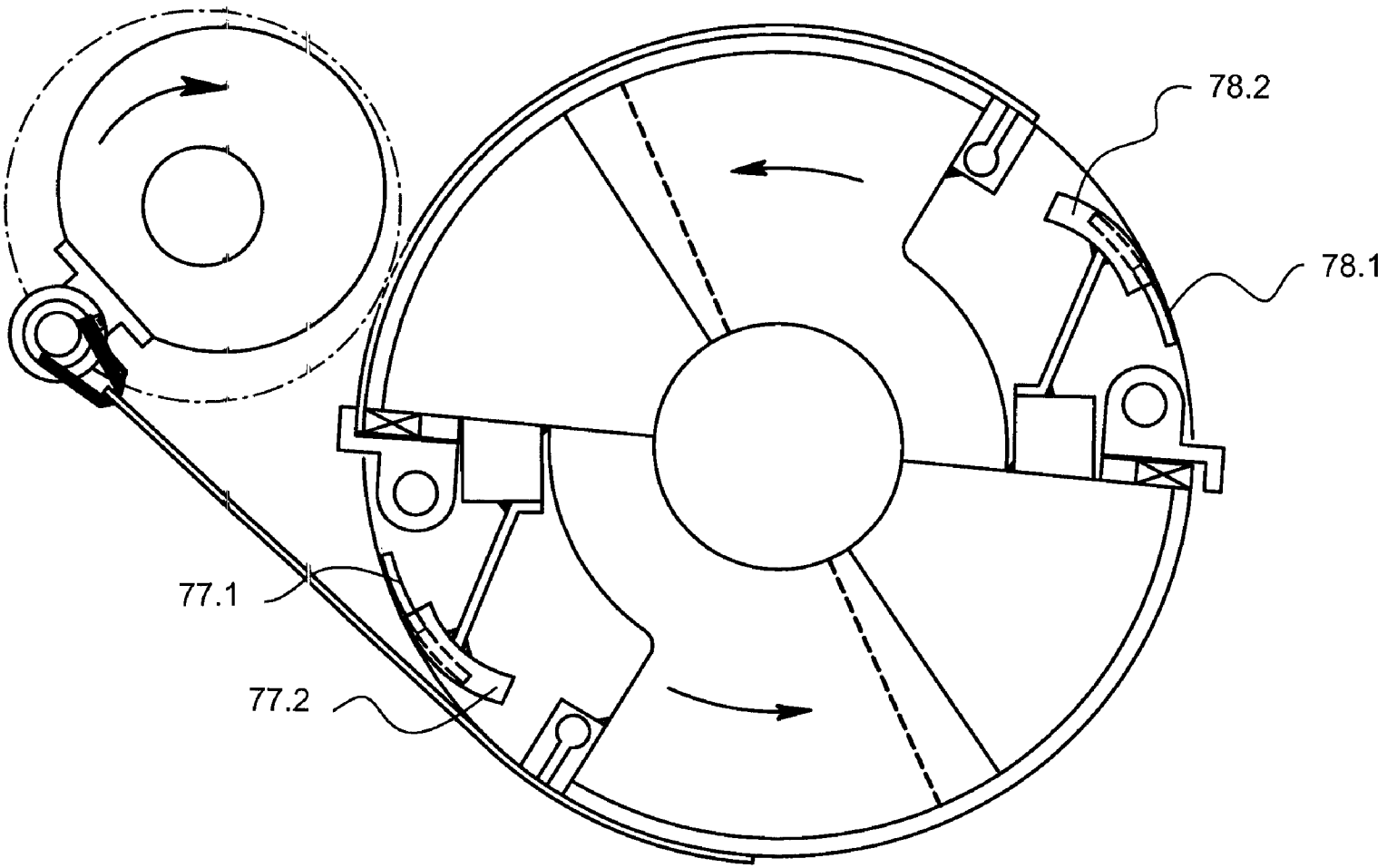
FIG. 7 is a cross-sectional view of a storage drum having guide elements that can be pushed into one another in circumferential direction.

In a variant according to FIG. 7, guide devices each having two guide plates 77.1, 77.2 and 78.1, 78.2 that can be pushed together telescopically are provided. In a way similar to the embodiment according to FIG. 6, clearances are created, in which the guide plate 77.1, 78.1 is pushed under the guide plate 77.2, 78.2 during recto printing operation.

Figure 8:
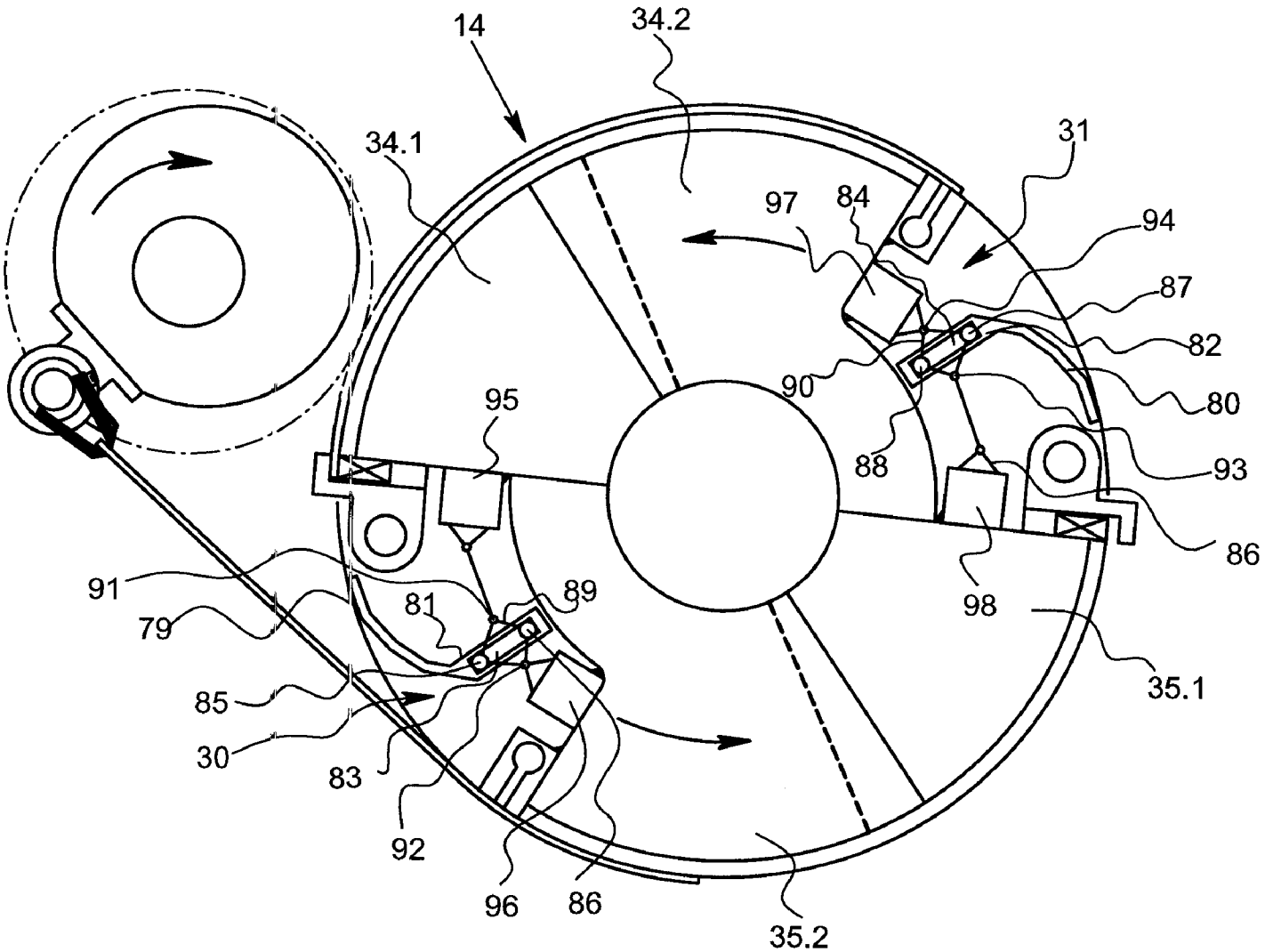
FIG. 8 is a cross-sectional view of a storage drum having guide devices standing centrally in channels.

FIG. 8 illustrates a variant in which guide plates 79, 80 are kept approximately centrally in the respective channel 30, 31 irrespective of the format setting of the holders 34.1, 34.2, 35.1, 35.2 in the direction of revolution of the storage drum 14. The guide plates 79, 80 have webs 81, 82 each having a slot 83, 84. Joint pins 85-88 of a jointed quadrilateral linkage 89, 90 are seated in the slots 83, 84. Joint pins 91-94 disposed outside the slots 83, 84 are connected in an articulated manner to bars 95-98, which are fixed to the holders 34.1, 34.2, 35.1, 35.2. If the holders 34.1, 34.2, 35.1, 35.2 are adjusted in the circumferential direction for the purpose of format setting, the joint pins 85-88 move into the slots 83, 84 and the guide plates 79, 80 maintain their circumferential position in the channels 30, 31.

The invention claimed is:

1. An apparatus for turning a sheet during transport through a printing press, the apparatus comprising:

a first transfer drum having a contour of revolution, two adjustable length circumferential support surfaces each being continuous along a circumferential direction of said transfer drum, and channels disposed between said circumferential support surfaces;

gripper systems disposed in said channels for holding the sheet at leading and trailing sheet edges;

a second transfer drum having a gripper system for accepting the sheet from said first transfer drum at the trailing sheet edge;

at least one drive for the synchronous revolution of said transfer drums; and guide elements covering said channels, each of said guide elements being a metal sheet having a guide surface located substantially at a level of and lying at an angle relative to said contour of revolution of said first transfer drum in radial direction.

2. The apparatus according to claim 1, wherein each of said guide elements is at least partly removable from a vicinity of said contour of revolution of said first transfer drum, for a printing press to be optionally set to print on one side of the sheet and to print on both sides of the sheet.

3. The apparatus according to claim 2, wherein said guide element is formed of two articulatingly interconnected metal sheets, and one of said metal sheets is pivotable away out of the vicinity of said contour of revolution when printing on only one side.

4. The apparatus according to claim 2, wherein said guide element is formed of two metal sheets, and one of said metal sheets is displaceable in circumferential direction of said first transfer drum relative to the other of said metal sheets when printing on only one side.

5. The apparatus according to claim 1, wherein said gripper systems of said first transfer drum are to be set to a sheet length in circumferential direction, and each of said guide elements is formed of two mutually displaceable metal sheets.

6. The apparatus according to claim 1, wherein said gripper systems of said first transfer drum are to be set to a sheet length in circumferential direction, and each of said guide elements is kept substantially centrally in said channel in circumferential direction during setting of said gripper systems relative to one another in circumferential direction of said first transfer drum.

* * * * *